US006213282B1

(12) United States Patent
Mokler et al.

(10) Patent No.: US 6,213,282 B1
(45) Date of Patent: Apr. 10, 2001

(54) METHOD AND APPARATUS FOR THE POSITIONALLY ACCURATE FEEDING OF SHEET-LIKE OBJECTS TO A TREATMENT PROCESS

(75) Inventors: Bernhard Mokler, Markgroeningen; Stephan Gericke, Ostfildern; Andreas Vollmann, Ludwigsburg, all of (DE)

(73) Assignee: LTG Holding GmbH (DE)

( * ) Notice: Subject to any disclaimer, the term of this patent is extended or adjusted under 35 U.S.C. 154(b) by 0 days.

(21) Appl. No.: 09/281,329

(22) Filed: Mar. 30, 1999

(30) Foreign Application Priority Data

Mar. 30, 1998 (DE) ..... 198 14 141

(51) Int. Cl.[7] ..... B65G 47/24
(52) U.S. Cl. ..... 198/415; 198/401
(58) Field of Search ..... 198/399, 401, 198/414, 415, 460.1, 461.1, 459.8, 861.6, 463.3

(56) References Cited

U.S. PATENT DOCUMENTS

| | | | | |
|---|---|---|---|---|
| 1,967,055 | * | 7/1934 | Green | 198/414 X |
| 4,433,319 | | 2/1984 | Lüder et al. | 338/34 |
| 4,451,027 | * | 5/1984 | Alper | 198/461.1 X |
| 4,492,135 | | 1/1985 | Ginn et al. | 83/155 |
| 4,541,904 | | 9/1985 | Lüder et al. | 204/38.3 |
| 5,293,984 | * | 3/1994 | Lucas | 198/414 |
| 5,341,915 | * | 8/1994 | Lordia et al. | 198/460.1 |
| 5,480,136 | | 1/1996 | Meyer | 271/176 |
| 5,718,057 | | 2/1998 | Rösli et al. | 33/617 |
| 5,857,672 | * | 1/1999 | Fowler et al. | 198/415 X |

FOREIGN PATENT DOCUMENTS

| | | | | |
|---|---|---|---|---|
| 0043001 | | 1/1982 | (EP) | G01N/27/12 |
| 784205A1 | | 7/1999 | (EP) | G01P/3/68 |
| 2 650990 | * | 2/1991 | (FR) | 198/401 |

* cited by examiner

*Primary Examiner*—James R. Bidwell
(74) *Attorney, Agent, or Firm*—Ostrolenk, Faber, Gerb & Soffen, LLP

(57) ABSTRACT

A method for the positionally accurate feeding of sheet-like objects to a treatment process, the objects being conveyed in succession in a lying position and being aligned during the conveyance. Rotational movement of the conveyed object is carried out to correct a skew position of the front edge of the object, a lateral movement of the object is carried out transversely, in particular at right angles, to the conveying direction for lateral alignment purposes, and an accelerated or decelerated longitudinal movement in the conveying direction is carried out for longitudinal alignment of the object, all the alignment movements being carried out on the surface of an object and without any mechanical alignment action on one or more peripheral edges of the object.

26 Claims, 3 Drawing Sheets

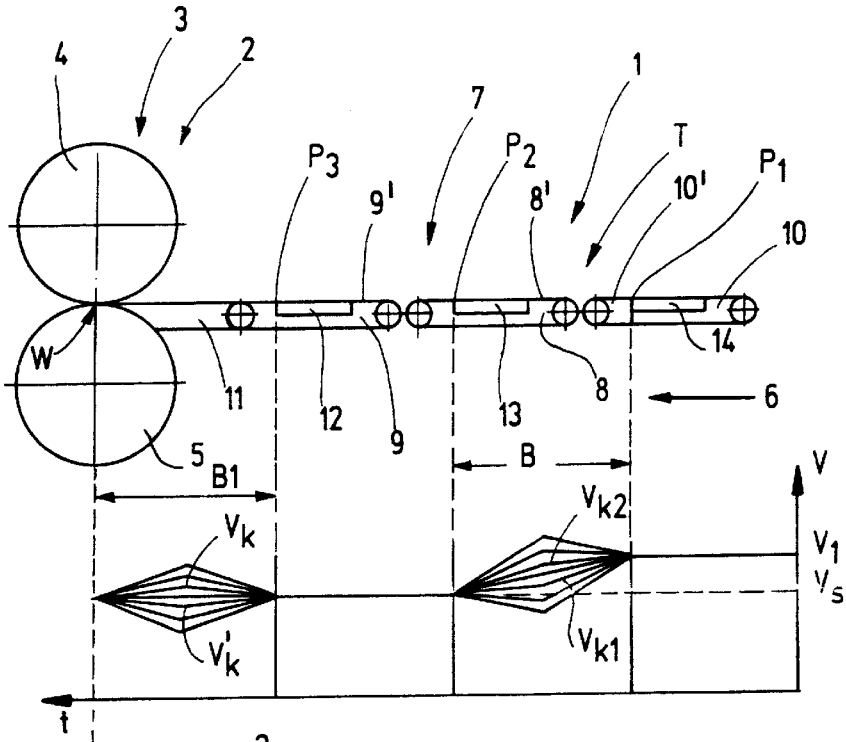
Fig. 1
Fig. 2
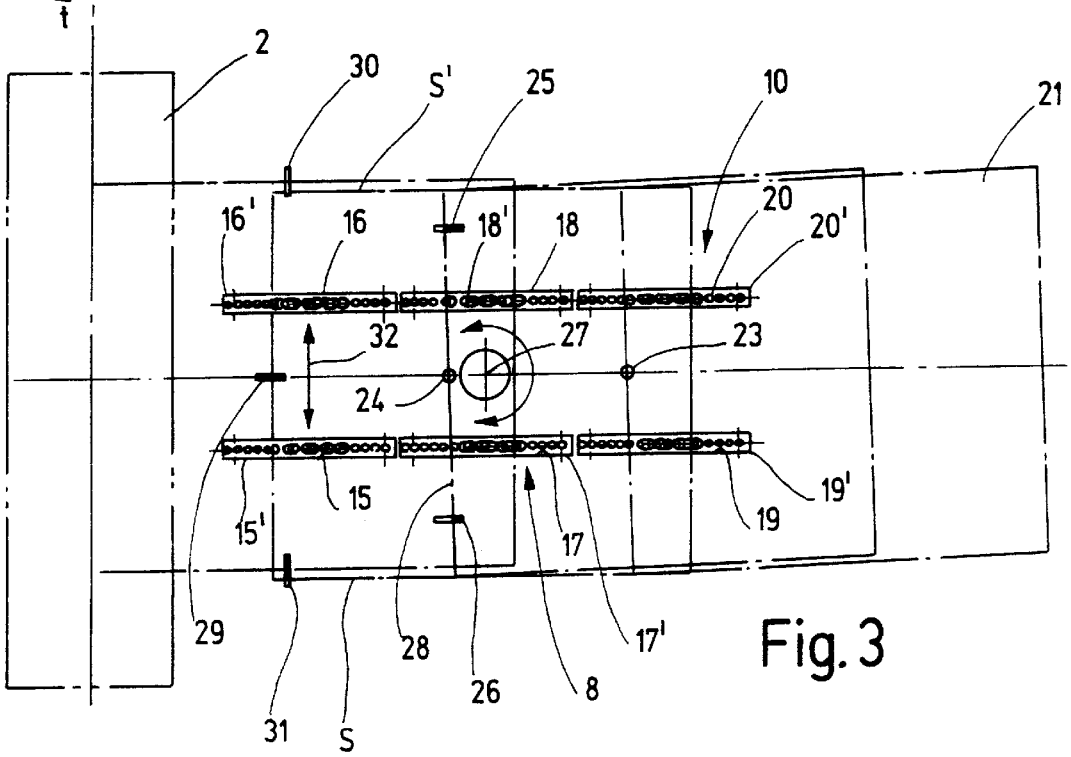
Fig. 3

METHOD AND APPARATUS FOR THE POSITIONALLY ACCURATE FEEDING OF SHEET-LIKE OBJECTS TO A TREATMENT PROCESS

BACKGROUND OF THE INVENTION

The invention relates to a method for positionally accurate feeding in sequence of sheet-like objects to a treatment process and aligning them, adjusting delivery and skew and relates to apparatus for the above-noted positionally accurate feeding of sheet-like objects to a treatment unit.

A method and an apparatus of the type mentioned above are known. To satisfactorily paint or print sheet-like objects, in particular sheet-metal plates, they must be fed to a treatment process, for example a painting or printing process, in a positionally accurate manner. It is known to mechanically align the sheet-metal plates using side markers, feed guide markers, plate stops, or the like. The sheet-metal plates, which are conveyed lying one behind the other, hit the feed guide markers or stops during the conveyance, to urge the sheet-metal plates into the desired or accurate position. A skewed position correction may develop. For example, the front edge of the sheet-metal plate may be aligned so that it is essentially at right angles to the conveying direction. Furthermore, the sheet-metal plate is aligned laterally, so that it can be fed to the treatment process in a central position. Finally, optimum longitudinal alignment of the sheet-metal plate with respect to the conveying path is required, in order for the plate to be fed to the treatment process or the treatment unit at the correct time.

Since the desire to save materials means that the sheet-metal plates become gradually thinner and because ever higher production rates are required, the known methods and apparatus may often cause damage to the edges of the plates, since the sheet-metal plates strike the stops or feed guide markers at a high velocity. This particularly damages sheet-metal plates of a small plate thickness.

SUMMARY OF THE INVENTION

Therefore, the object of the invention is to provide a method and an apparatus for positionally accurate feeding of sheet-like objects to a treatment process or a treatment unit, which achieve high production rates even for thin plates.

The object is achieved by the following method. The sheet-like objects are conveyed in succession in a lying position and are aligned during the conveyance, so that the objects are fed to a treatment process in a positionally accurate manner. The invention provides for rotational movement of the object to correct a skew position of the front edge of the object. For lateral alignment, a lateral movement of the object is carried out transversely, in particular at right angles, to the conveying direction. Longitudinal alignment of the object is achieved by accelerated or decelerated longitudinal movement in the conveying direction. If the position of an object is corrected, the object does not strike a stop, or the like. Instead, a drive force and/or a drive moment is applied to the sheet-like object, in particular a sheet-metal plate, which force/moment causes the applicable rotational movement, the lateral alignment, acceleration or deceleration of the object. This makes it possible to increase the production rate of the treatment process, i.e. to treat a higher number of objects per unit time. Furthermore, it also makes it possible to process particularly thin sheet-metal plates without damaging them.

In a preferred embodiment, the object undergoes preliminary alignment. This means that the object or the sheet-metal plates are roughly aligned before the accurate position for feeding the object to the treatment process is reached. The preliminary alignment may be provided particularly when the objects are supplied from a feeder, which is also known as a separating device, because the feeder supplies the objects in a relatively inaccurate position for conveyance to the treatment process. To enable the positionally accurate alignment of the sheet-metal plates to take place immediately before they are fed to the treatment process, there is provision particularly for the skew position correction, the lateral alignment and the longitudinal alignment to be carried out within a relatively narrow tolerance range, so that the objects do not have to cover unnecessarily long distances immediately before the treatment process. This permits the positionally accurate alignment to take place relatively quickly.

In a further development, when the object is transferred to the treatment process, its feed velocity is equal to or approximately equal to the velocity of an object in the treatment process. This produces particularly good treatment results in the subsequent printing or painting unit.

In preferred exemplary embodiment, the object is at least temporarily held fixed to its conveying support during the conveyance. This enables the object to rest on the conveying support. As an alternative, the object may be conveyed in a suspended manner and thus to be held on its large area top side. In particular, the object may be held in place by a magnetic and/or vacuum or suction effect.

In an exemplary embodiment, the rotational, lateral and/or longitudinal movements of the object take place simultaneously, or at least two of these movements take place simultaneously.

In a further preferred embodiment, the rotational, lateral and/or longitudinal movements take place in succession. There is provision in particular for at least the rotational movement, and then, if appropriate, the lateral and/or longitudinal movement, to take place.

A further development of the invention provides for the actual position of the object to be detected or determined in order to correct its skew position, and/or lateral position and/or longitudinal position.

A still further development of the invention holds the object in place by being sucked on by means of a vacuum or by a magnetic field during the first conveying path. In this case, a skew position of the object is detected in the area of the first conveying path. Afterward, rotational movement is performed for correcting the skew position. Then, the object is transferred to a second conveying path. At the same time, the vacuum or the magnetic field in the area of the first conveying path is gradually removed, while a vacuum or a magnetic field is built up in the area of the second conveying path in order to hold the object. After this, the lateral position and the longitudinal position of the object are determined. If a correction is required, the lateral movement and/or the longitudinal movement is/are carried out in the area of the second conveying path. Finally, the object is fed to the treatment process at a conveying velocity which corresponds to or is equal to the object velocity in the treatment process.

The invention also concerns apparatus for positionally accurate feeding of sheet-like objects to a treatment unit. In particular, sheet-metal plates are fed in a positionally accurate manner to a printing or painting unit of a sheet-metal coating machine, which forms the treatment unit. The objects to be fed are positioned in succession in a lying position. The objects are conveyed by a conveyor device. The objects are aligned during conveyance by an alignment apparatus. In order to correct a skew position of the front edge of an object, the conveyor apparatus is mounted to be rotatable about a shaft or it has two conveyor means which lie at a distance from one another and are able to adopt different conveying velocities. The different conveying velocities of the conveyor means allow the object to be rotated to corrects its skew position. For laterally aligning the object, the conveyor apparatus is displaceable transversely to the conveying direction. For longitudinal alignment of the object, the conveyor apparatus may be displaceable in the conveying direction. As an alternative, the conveyor means of the conveyor device may be capable of being accelerated and/or decelerated. Because the conveyor apparatus can be displaced and/or the conveying velocities of the conveyor means can be varied, for positionally accurate alignment of the object, this makes it possible to dispense with mechanical stops which may damage the object.

Furthermore, it is also advantageously possible to increase the conveying velocity and therefore the production rate, i.e. the number of objects processed per unit time.

A preferred embodiment provides for two conveyor devices. As seen in the conveying direction, the first one is mounted so that it can rotate about the shaft and the second one can be displaced transversely to the conveying direction. The first conveyor device can carry out the skew position correction by rotating the conveyor device, while the second conveyor device can laterally align the object.

In a preferred exemplary embodiment, the second conveyor device has conveyor means which can be accelerated and/or decelerated. Thus, in addition to the lateral alignment, the second conveyor device also longitudinally aligns the object.

In a further development, a preliminary alignment/conveyor unit is arranged upstream of the first conveyor device, as seen in the conveying direction. This preliminary alignment/conveyor unit can be used to roughly align the object, so that subsequent positionally accurate aligning of the object does not require considerable distances of the conveyor apparatus or the two conveyor devices for skew position correction, lateral alignment and longitudinal alignment of the object. This makes it possible for a particularly positionally accurate, rapid feeding of sheet-like objects to the treatment unit.

A particularly preferred embodiment has two spaced-apart sensors which detect the front edge of the object. This makes it particularly easy to detect any skew position of the front edge of the object, making appropriate correction of the skew position easy.

In an exemplary embodiment, at least one sensor detects a side edge of the object, making it simple to determine the lateral alignment of the object.

In a further development, the front and/or rear edge of the object is detected by means a sensor, so that the above-mentioned longitudinal alignment of the object can be detected and a positionally accurate feed to the downstream treatment unit is possible by means of suitable correction using the conveyor apparatus.

Other objects and features of the invention are explained below on the basis of exemplary embodiments and with reference to the drawings.

BRIEF DESCRIPTION OF THE DRAWINGS

FIG. 1 shows a diagrammatic side view of apparatus for positionally accurate feeding of sheet-like objects to a treatment unit, FIG. 2 shows a velocity-time diagram of a sheet-like object which is conveyed on the apparatus FIG. 1, FIG. 3 shows a plan view of the apparatus in accordance with FIG. 1, with sheet-like objects resting on the apparatus.

DESCRIPTION OF PREFERRED EMBODIMENT

Figure 4:
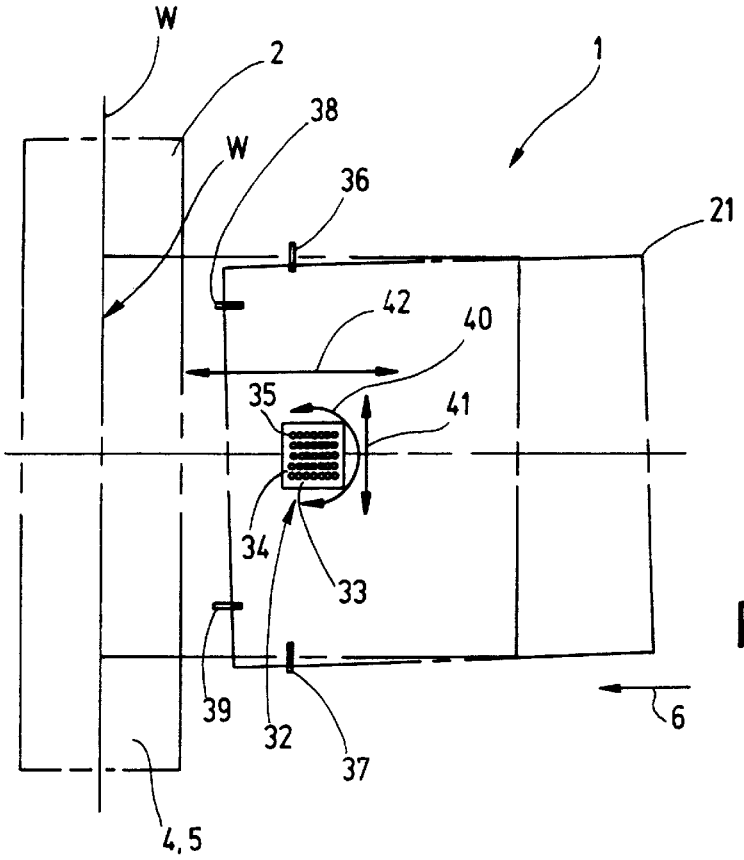
FIG. 4 shows a plan view of a second embodiment of apparatus for the positionally accurate feeding of sheet-like objects to the treatment unit.

FIG. 1 shows a feed device 1 for the positionally accurate feeding of sheet-like objects to a treatment unit 2 which, for example, comprises a sheet-metal plate painting machine 3. The only parts of the painting machine 3 shown are painting cylinders 4 and 5. The painting machine 3 is downstream of the feed device 1 in the conveying direction 6 of objects. A separation device, not shown also referred to as a feeder, may be arranged upstream of the feed device 1.

The feed device 1 comprises a conveyor apparatus 7 which includes a first conveyor device 8 and a second conveyor device 9. The feed device 1 further includes a preliminary alignment/conveyor unit 10 and a carrier device 11. It is possible for the carrier device 11 to provide an air cushion which assists in transferring the objects from the conveyor apparatus 7 to the treatment unit 2. In the conveying direction 6, the preliminary alignment/conveyor unit 10, the first conveyor device 8, the second conveyor device 9 and the carrier unit 11 are connected in series one after another, making it readily possible to transfer an object from one station to the next.

Each of the first and second conveyor devices 8 and 9, and the preliminary alignment/conveyor unit 10, has a respective holding device 13, 12 and 14, which holds an object which is resting on the conveying path in place. For this purpose, the holding device 12, 13 and/or 14 may produce a magnetic effect and/or a vacuum effect acting on the object. Each of the holding devices 12, 13 and 14 can be switched on and off independently of one another.

The first and second conveyor devices 8 and 9 and the preliminary alignment/conveyor unit 10 are designed, for example, as suction belt paths 8', 9' and 10' which each comprise two conveyor means 15, 16, and 17, 18 and 19, 20 (FIG. 3) that run parallel to and at a distance from one another to form a conveying support T. The conveyor means 15, 16, 17, 18, 19 and 20 comprise revolving suction belts 15', 16', 17', 18', 19' and 20' to which a vacuum can be applied by their associated holding device 12, 13 or 14, so that an object 21 which is to be conveyed can be held in place on the conveyor means 15 to 20.

A drive can act on the conveyor means 15 to 20. This preferably provides for each conveyor means 15 to 20 to be assigned an independently operating drive means. Preferably, it is also possible for each respective drive to drive the corresponding conveyor means 15 to 20 at a variable velocity in the conveying direction 6. This drives the conveyor means 15 to 20 at a velocity which is equal to, greater than or less than a desired conveying velocity $v_s$.

Conveyance with positionally accurate feeding of an object 21 to the treatment unit 2 by the feed device 1 is now described with reference to FIGS. 1 to 3:

From the feeder (not shown here), the object 21, in particular a sheet-metal plate, is fed to the preliminary alignment/conveyor unit 10 from the right. The sheet-metal plate-is in this case moving at a velocity $v_1$ which may lie above a desired conveying velocity $v_s$. When the object 21 is transferred to the preliminary alignment/conveyor unit 10, the holding device 14 is activated, so that the sheet-metal plate can be held in place on the preliminary alignment/conveyor unit 10 and, as a result, the plate can be conveyed onward securely in the conveying direction 6. When a front edge 28 of the sheet-metal plate has reached a position $P_1$ and the sheet-metal plate is then held securely by the holding device 14, the sheet-metal plate is accelerated or decelerated to the desired conveying velocity $v_s$, which corresponds to the treatment velocity in the treatment unit 2. The position of the front edge 28 of the sheet-metal plate is determined by a sensor 23 (FIG. 3) which is assigned to the position $P_1$. This sensor 23 is preferably comprised of a so-called CCD chip, having a sensor matrix which is formed by individual light-sensitive sensor elements. A light source is arranged above the sensor 23 and is preferably strong and is directed onto the sensor 23. Depending on how many and which ones of the light-sensitive sensor elements of the CCD chip are covered by the sheet-metal plate, it is possible to determine the position of the object 21 or the sheet-metal plate on the conveying path. Furthermore, based on the light-sensitive sensor elements of the CCD chip covered per unit time, it is possible to establish the conveying velocity v of the sheet-metal plate. When the position and the velocity of the sheet-metal plate 21 have been determined, the plate 21 is aligned by the preliminary alignment/conveyor unit 10. For this purpose, it is possible to selectively drive either or both of the conveyor means 19 and 20 in a decelerated or accelerated manner, for reducing the velocity or carrying out longitudinal alignment, as indicated by the correction velocities $v_{k1}$ and $v_{k2}$ in FIG. 2. The correction velocities $v_{k1}$ and $v_{k2}$ are variable, in the area B of the preliminary alignment/conveyor unit 10, as illustrated by the group of curves shown in FIG. 2. Furthermore, it is possible to displace the preliminary alignment/conveyor unit 10 laterally, i.e. essentially perpendicular to the conveying direction 6. When the object 21 is conveyed onward, its front edge 28 reaches a position $P_2$. There is a sensor 24, which may be of identical design to the sensor 23, i.e. it may be designed as a CCD chip, and which determines the conveying velocity of the object. The holding device 13 of the first conveyor device 8 is activated while the holding device 14 of the preliminary alignment/conveyor unit 10 is deactivated, so that the object 21 can no longer be affected by the preliminary alignment/conveyor unit 10.

The skew position of the object 21 is determined preferably by two sensors 25 and 26, which may be designed as CCD chips. The longitudinal extent of the sensors 25 and 26 lies in the conveying direction 6. The skew position of the object 21 is corrected by the first conveyor device 8, which is preferably rotatably mounted about a vertical shaft 27. The first conveyor device 8 is preferably rotatable about the shaft 27 by a drive not shown here, until the front edge 28 of the object 21 lies essentially at right angles to the conveying direction 6 or parallel to a roller contact line W. This rotation is determined by means of the sensors 25 and 26.

As illustrated in FIG. 2, the object 21 is conveyed onward at the desired velocity $v_s$ during the skew position correction.

As an alternative to correcting the skew position by rotatable mounting of the first conveyor device 8, it is also quite possible to drive the conveyor means 17 and 18 at different velocities for correcting the skew position, i.e. by rotation of the object 21.

When the front edge 28 has reached a position $P_3$ as it is conveyed onward, the longitudinal alignment of the object 21 is determined by a further sensor 29, the longitudinal extent of which lies in the conveying direction 6. The sensor 29 may likewise be a CCD chip.

The lateral alignment of the object 21 is preferably detected by two sensors 30 and 31 which may be designed as CCD chips assigned to the side edges S and S' of the object 21. Then, the holding device 12 of the second conveyor device 9 is activated, and preferably the holding device 13 of the first conveyor device 8 is switched off. The actual position of the object 21 is determined by the sensors 29, 30 and 31, and it is then possible to correct this to the desired position. For this purpose, the second conveyor device 9 can preferably be displaced essentially transversely to the conveying direction 6, as indicated by the arrow 32. Furthermore, the second conveyor device 9 can be displaced either in or oppositely to the conveying direction 6, so that the object 21 can be optimally aligned with respect to the treatment unit 2 which is connected downstream. Displacement of the conveyor device 9 oppositely to the conveying direction 6 is also provided in order to ensure that the conveyor device 9 can be moved back into its normal position for receiving a further object after it has been displaced for longitudinally aligning the object 21 in the conveying direction 6. As an alternative, the conveyor means 15 and 16 may be driven at a velocity which is either above and/or below the desired velocity $v_s$. The desired position with regard to the longitudinal alignment of the object 21 is defined by the normal position of the treatment unit 2. In particular, the object 21 is to be fed to the painting cylinders 4 and 5 when they are in the normal position and the operation or the painting operation is to begin. This means that the object 21 is to bear against or be present at the roller contact line W at the precise moment that the painting cylinders 4 and 5 are in the normal positions. To feed the object 21 accurately between the two painting cylinders 4 and 5, the object 21 is supported by the carrier unit 11. Preferably, the roller contact line W and the normal position of the painting cylinders 4 and 5 are used as a feedback preset for a control circuit with a closed control loop. A control circuit controls the feed device 1 as a function of the normal position of the painting cylinders 4 and 5 and the roller contact line W. This means that the position of an object is determined by means of the sensors. Then a comparison is made as to whether the object would be present at the roller contact line W at the correct time, i.e. when the painting cylinders 4 and 5 are in their normal position. If any deviation is established, a correction is made, particularly for the longitudinal alignment of the object, by the control circuit which controls the feed device 1.

As an alternative, however, it is also possible to control the feed device 1 by an open-loop control circuit, i.e. without a closed control loop. For this purpose, an object is fed to the treatment unit 2 as a function of a predeterminable cycle, so that objects are fed to the treatment unit 2 at essentially constant time intervals. A cycle of this nature is adapted to the treatment velocity of the treatment unit 2.

If the object 21 arrives at the position $P_3$ at a decelerated velocity with respect to the normal position of the treatment unit 2, it is possible to accelerate the object 21, as illustrated in FIG. 2. First, the object 21 is accelerated to a correction velocity $v_k$, and then it is decelerated back to the desired velocity $v_s$. The correction velocity $v_k$ is selected so that the object 21 would reach the treatment unit 2 prematurely, if the velocity $v_k$ were maintained. Accurate, desired longitudinal alignment is achieved only by then decelerating the object 21.

If the object 21 or its front edge 28 has reached a position which is in front of the desired position in the conveying direction 6, the object 21 is decelerated to a correction velocity $v'_k$ which is below the desired velocity $v_s$. Subsequently, acceleration of the object 21 then feeds it to the treatment unit 2 at the desired time. This too, makes it possible to feed the object 21 to the painting cylinders 4 and 5 in a positionally accurate manner. The correction velocities $v'_k$ and $v_k$ are variable and can be adapted to any longitudinal alignment of the object required. Different correction velocities are shown in the area B1 of longitudinal alignment in FIG. 2.

In the feed device 1 of FIGS. 1 to 3, in addition to or as an alternative to driving the conveyor means 15 to 18 at different correction velocities, the first and/or second conveyor device 8 or 9, respectively, and/or the preliminary alignment/conveyor unit 10 may be designed as a linear unit. This means that these conveyor units for correcting the position of the object may be designed so that they can all be displaced by a preferably linear drive. Naturally, it is also possible to use a combination of the two methods. For example, it is possible to drive the conveyor means 15 and 16 of the first conveyor device 8 at the different correction velocities and to design the second conveyor device to be linearly displaceable. It is also possible to displace one conveyor device in a linear manner and to drive the conveyor means of this conveyor device at different correction velocities.

FIG. 4 shows a second embodiment of a feed device 1 which comprises a conveyor device 32 which includes a holding device 33. The holding device 33 comprises a suction head 34 including a plurality of suction elements 35 to which vacuum can be applied. Naturally, it is also possible to design the holding device 33 as a magnetic, in particular electromagnetic, holding device.

The feed device 1 in accordance with FIG. 4 furthermore has sensors 36, 37, 38 and 39, which may be designed as CCD chips. Preferably, each sensor 36, 37, 38, 39 is assigned a respective light source, so that the object 21 blocks light to the sensors 36, 37, 38 and 39 depending on the position of the light emitted by the light source. This makes it possible to determine the position of the object 21. In particular, the feed device 1 in FIG. 4 is assigned a control circuit to which the output signals from the sensors 36, 37, 38 and 39 are fed, enabling the conveyor device 32 to be controlled as a function of the normal position of the painting cylinders 4 and 5 such that an object is always fed to the treatment unit 2 or roller contact line W when the painting cylinders 4 and 5 are in the normal position. Therefore, here too, a closed control loop is provided, with the desired values for the control circuit being formed at least by the operating position of the treatment unit 2. In particular, the treatment velocity and the normal position of the painting cylinders 4 and 5 are involved in this process. In particular, the control circuit is of fully electronic design.

This produces the following method of operation:

The object 21 which has been fed from the feeder (not shown here) is held by the holding device 33 and is held in place by the suction elements 35 on the suction head 34. After the position of the object 21 has been determined by means of the sensors 36, 37, 38 and 39, the position of the object 21 is corrected as required. For this purpose, the holding device 33 is mounted and can be driven rotatably in order to correct the skew position, as indicated by the arrow 40. Furthermore, the holding device 33 can be displaced, in particular at right angles to the conveying direction 6 of the object 21, as indicated by the arrow 41. Finally, the holding device 33 or conveyor device 32 can be displaced in the conveying direction 6 for longitudinally aligning the object 21, as indicated by the arrow 42. The conveyor device 32 is preferably displaceable oppositely to the conveying direction 6, so that after displacement in the conveying direction 6 it can be moved back into the normal position to receive a further object.

Consequently, the fact that the holding device 33 can be moved or displaced in three ways makes it possible to feed objects to a downstream treatment unit 2 in a positionally accurate manner. This means that an object 21 is fed when the painting cylinders 4 and 5 are in the normal position, so that optimum painting or printing results can be achieved on the object 21.

It is also possible to assign the feed device 1 or the conveyor device 32 in accordance with FIG. 4 a preliminary alignment/conveyor unit 10 as described in relation to FIGS. 1 to 3.

Figure 5:
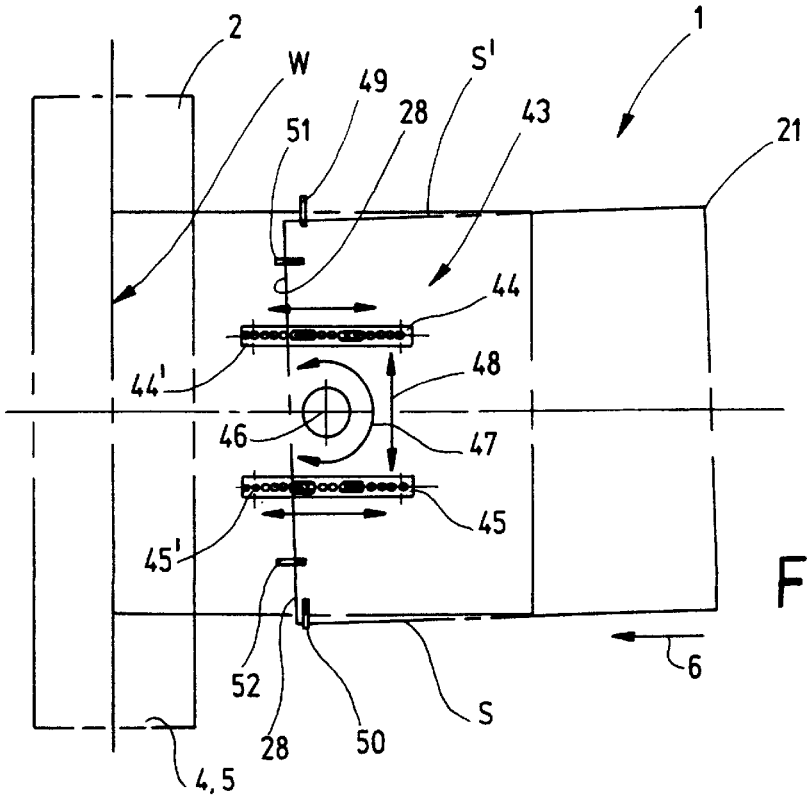
FIG. 5 shows a plan view of a third embodiment of such an apparatus.

FIG. 5 shows a third exemplary embodiment of a feed device 1 which has a conveyor device 43. The conveyor device 43 has conveyor means 44 and 45 which comprise suction belt paths 44' and 45', respectively. The conveyor means 44 and 45 lie parallel to and at a distance from one another. Each can be driven, independently of the other, at variable velocities in the conveying direction 6. This means that the conveyor means 44 and 45 can be driven at a velocity which is greater than, equal to or less than a desired conveying velocity $v_s$. Furthermore, the conveyor device 43 is preferably mounted so that it can rotate about a vertical shaft 46 about which it can be driven in both directions of rotation 47. Finally, the conveyor device 43 is preferably displaceable essentially at right angles to the conveying direction 6, as indicated by the arrow 48. A preliminary alignment/conveyor unit 10, described with reference to FIGS. 1 to 3, may be connected upstream of the conveyor device 43.

The conveyor device 43 is assigned sensors 49, 50, 51 and 52, which are preferably designed as CCD chips. The sensors 49 and 50 to detect the lateral alignment of the object 21. The sensors 51 and 52 determine both the longitudinal alignment and the skew position of the object 21, so that if necessary the position of the object 21 can be corrected, thus ensuring a positionally accurate feed to the treatment unit 2.

For longitudinal alignment, i.e. for feeding the objects to the treatment unit 2 at correct times, the conveyor means 44 and 45 can be driven at variable velocities, e.g. more quickly or more slowly than the desired velocity $v_s$. To correct the skew position, the entire conveyor device 43 is preferably rotatable about the vertical shaft 46, so that the front edge 28 of the object 21 can be aligned essentially at right angles to the conveying direction 6 or parallel to the roller contact line W of the treatment unit 2. For laterally aligning the object 21, it is preferable for the entire conveyor device 43 to be able to move in both directions indicated by the arrow 48. All of the correction movements may be carried out simultaneously by the conveyor device 43. For this purpose, the conveyor device 43 may be movable in a direction indicated by the arrow 48, for laterally aligning the object 21, while at the same time the conveyor means 44 and 45 are at the same conveying velocity, which may be greater than, equal to or less than the desired conveying velocity, so that the object can be longitudinally aligned, and while at the same time the entire conveyor device 43 can be driven about its shaft 46 in a direction to correct the skew position of the object 21. However, it is also possible, to correct the skew position, to drive the conveyor means 44 and 45 at different velocities. In that case, these two different velocities may also be greater than, equal to or less than the desired conveying velocity, so that the conveyor means 44 and 45 can be used to carry out both the longitudinal alignment and the skew position correction of the object 21. In order for the skew position correction, the longitudinal alignment and the lateral alignment of the object to be able to take place simultaneously, the position of the object 21 is detected by means of all the sensors 49, 50, 51 and 52 simultaneously.

The embodiment of the feed device 1 in FIG. 5 is distinguished by the fact that only one sensor, which may be designed as a CCD chip, is used to determine the position of the object 21. The multiplicity of individual sensor elements of the sensor matrix of a CCD chip of this nature makes it possible to determine the longitudinal position, the lateral alignment and the longitudinal alignment of the object 21 on the basis of the sensor elements covered by the object 21. To this end, this sensor may be assigned to one corner of the object 21. It is thus possible for one sensor to detect at least one side edge S or S' and the front edge 28 of the object 21. It should be particularly emphasized here that the feed device 1 can be used to feed an object to the treatment unit 2 with an accuracy which is better than 0.1 mm.

To hold an object 21 securely on the conveyor device 43, the conveyor device 43 preferably has a holding device 12, described in relation to FIG. 1. In particular, the suction belt paths 44' and 45' may be fed from a vacuum source, so that the object 21 can be held securely in place. Naturally, however, in this case too it is possible to provide an electromagnetic holding function instead of the suction effect.

Figure 6:
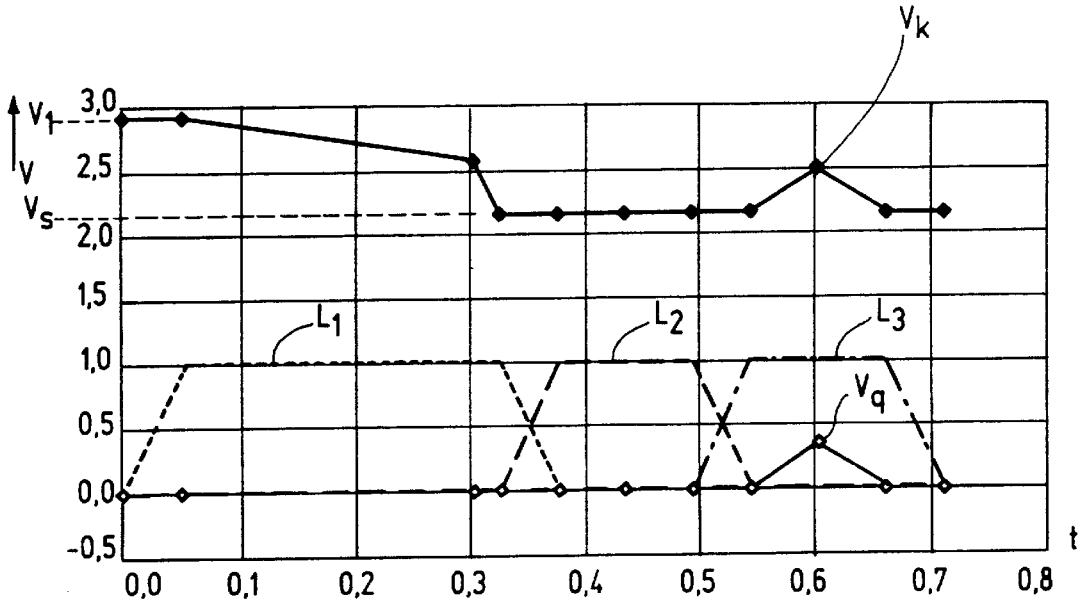
FIG. 6 shows a sequence of movements of an object on the apparatus in accordance with FIG. 1.

FIG. 6 shows the relationship between the conveying duration of an object and its conveying velocity v. The Figure also illustrates the activation and deactivation of the holding devices 12, 13 and 14.

After leaving the feeder, an object 21 is at a conveying velocity $v_1$. When it reaches the preliminary alignment/conveyor device 10, the holding device 14 is activated, as indicated by the dashed line $L_1$. After the holding device 14 has reached its maximum holding power, i.e. once the object is resting securely on the preliminary alignment/conveyor unit 10, the conveying velocity is reduced in steps to the desired conveying velocity $v_s$, which corresponds to the treatment velocity in the treatment unit 2. The object 21 has now essentially reached the position $P_2$ (FIG. 1), so that the holding device 13 is activated (line $L_2$) while the holding device 14 is deactivated. While the object is held in place on the first conveyor device 8 by the holding device 13, the skew position of the object 21 is corrected, during which process the conveying velocity essentially corresponds to the desired velocity $v_s$. As soon as the object has essentially reached the position $P_3$ (FIG. 1), the holding device 13 is deactivated and its holding action is removed. At the same time, the holding device 12 is switched on (line $L_3$). As soon as the holding device 12 has reached its maximum action, i.e. when the object is held securely on the second conveyor device 9, the longitudinal and lateral alignments are corrected. For the purpose of the longitudinal alignment, it is assumed here, by way of example, that the object 21 is fed to the treatment unit 2 in a decelerated or delayed manner. This is prevented by accelerating the object 21 to a higher velocity $v_k$ by the second conveyor device 9, in order to make up for the deceleration. Then, the object is decelerated again, so that it can be transferred to the treatment unit 2 at the desired velocity $v_s$ in a positionally accurate manner. The painting cylinders 4 and 5 are then in the normal position and the front edge 28 of the object 21 is situated at the roller contact line W.

FIG. 6 also shows that the second conveyor device 9 is displaced laterally, in the direction of arrow 32 (FIG. 3), at increasing or decreasing velocity $v_q$. This results in the lateral displacement or lateral correction of the object 21, so that it can be fed to the treatment unit 2 in a central position.

While an object is present on the conveyor devices which have been described in connection with FIGS. 1 to 6 and its position is being corrected by displacing the appropriate conveyor device, the conveyor device in question is reset just when there is no object present on this conveyor device. It is therefore possible to reset the conveyor devices to the normal position between a first and a second object to be conveyed.

It has been assumed above that the sensors 23 to 26 and 36 to 39 and 49 to 52 are so-called CCD chips. Naturally, other types of sensors may also be used. By way of example, it is possible to use light barriers, laser scanners, in particular laser light barriers or proximity sensors which operate electromagnetically. It is merely necessary to ensure that the sensors are able to determine the position of the object with sufficient accuracy, which is better than 0.1 mm. Furthermore, the sensors must be designed so that they allow the position of each sheet-metal plate to be determined reliably at production or treatment rates of, for example, two sheet-metal plates per second. In order to be able to correct the position of the object with an accuracy which is better than 0.1 mm, there may also be two sensors for one side edge S or S', so that the lateral position of the object can also be determined accurately. This is advantageous in particular if a side edge S or S' is to be aligned with respect to the center axis of the feed device 1. Then, if appropriate, the front edge 20 of the object 21 may be assigned only one sensor.

To achieve a positioning accuracy of better than 0.1 mm, drive servomotors are provided for the displacing the conveyor devices or driving the conveyor means. For drive servomotor systems of this nature, it is preferable to use DC motors which are powered via closed-loop or open-loop controlled converters or the like. Drive servomotor systems of this nature are distinguished by a high positioning accuracy. If a conveyor device is to be displaced, they may be fitted with mechanical displacement units which have very low tolerances and therefore allow accurate positioning of the component which is to be displaced. In particular, these are so-called linear units which are distinguished by high acceleration or deceleration levels and accurate positioning features. Naturally, it is also possible to use a linear motor, if appropriate with carriages, instead of a servomotor and a mechanical displacement unit, particularly a carriage. This makes it possible, particularly in combination with the CCD chips described above, which may form the sensors, to achieve a positional accuracy of the sheet-metal plates which in the prior art was possible only by using mechanical stops. The fact that the object is held flat on the corresponding conveyor devices or on the conveyor means makes it possible, in a particularly simple manner, to apply the drive forces or drive moments which are to be used for conveyance and alignment (longitudinal and lateral alignment and skew position correction) to the surface, i.e. to a top and/or bottom side of the object. It is thus possible to dispense with applying mechanical alignment means to one or more peripheral edges of the object, as are used in the prior art. Such alignment action at the peripheral edges may damage the objects, particularly at high production rates and when the sheet-metal plates have a small thickness.

Advantageously, it is possible, when using the CCD chips, to detect a certain detection area, i.e. not simply to detect points. It is advantageous to detect an area, as this makes it possible to detect the object or the sheet-metal plate even if it lies outside a tolerance range or if the sheet-metal plate deviates from an expected position. There is therefore provision for the alignment operation carried out on the object to be adapted to the actual position of the object. This is advantageous since it allows sheet-metal plates to be fed without interruption by the feed device. This produces an uninterrupted flow of objects in which, nevertheless, the position of each object is detected individually by means of the sensors, so that the object can be aligned into the desired position while it is being conveyed.

To determine the normal position of the treatment unit 2, at least one of the painting cylinders 4 and/or 5 may be assigned a so-called incremental sensor. The sensor enables the current rotational position of the painting cylinders 4 and 5 to be determined. This makes it simple to determine the normal position of the painting cylinders. This normal position then serves as a comparative value for the actual position of the object or of the front edge of the object, so that the object is fed to the roller contact line W when the painting cylinders 4 and 5 are in their normal positions.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method for positionally accurately feeding sheet-like objects to a subsequent process, each object having peripheral edges and having surfaces, the method comprising:

temporarily holding the object to a conveying support by at least one of a magnetic effect and a vacuum effect;

conveying the objects in succession lying down;

aligning each object during its conveyance, comprising;

rotating the object around a vertical axis to correct the skew position of the front end of the object;

laterally moving the object transversely to the direction of conveyance to laterally align the object;

selectively accelerating or decelerating the longitudinal movement of the object in the conveying direction;

all of the conveying, aligning, laterally moving, accelerating and decelerating the movement of the object being performed on the object to bring the object to the further process without mechanical alignment action on one of the peripheral edges of the object.

2. The method of claim 1, further comprising preliminary aligning of the object before the alignment during conveying of the object.

3. The method of claim 1, wherein the subsequent process after the alignment of the object has a desired feed velocity for the object in the subsequent process;

the method further comprising transferring the object to the subsequent process at a feed velocity at least approximately equal to the desired velocity of the object in the subsequent process.

4. The method of claim 1, wherein at least two of the rotating, lateral movement and longitudinal acceleration or deceleration during the aligning of the object occur simultaneously.

5. The method of claim 1, wherein the rotating, lateral movement and longitudinal acceleration or deceleration during the aligning of the object occur one after the other in a selected sequence.

6. The method of claim 5, wherein the rotating occurs and thereafter the lateral movement or longitudinal acceleration or deceleration occur if required.

7. The method of claim 1, further comprising determining the actual position of the object being conveyed for providing information for correcting the aligning of the object.

8. The method of claim 7, wherein the actual position of the object is determined by a sensor comprised of a CCD chip which detects the actual position of the object and wherein the CCD chip has a sensor matrix including a plurality of light sensitive sensor elements and a light source directed at the sensor matrix, and wherein determining the actual position of the object comprises determining which of the sensor elements are covered by the object.

9. The method of claim 8, further comprising determining the velocity of the object in the conveying direction as a function of the sensor elements covered by the object per unit time.

10. The method of claim 1, wherein the object has a conveying path with a first part;

the method comprising holding the object in place on the first part of the conveying path by suction or by magnetic field, the skew position of the object being detected in the area of the first conveying path, the rotation of the object to correct the skew position occurring in the area of the first conveying path after the skew position has been determined;

transferring the object from the first conveying path to a second conveying path;

the vacuum or the magnetic field in the area of the first conveying path is gradually removed while a vacuum or magnetic field is built up in the area of the second conveying path to hold the object there, the lateral position and longitudinal position of the object are determined in the second conveying path, the lateral movement and/or longitudinal acceleration or deceleration of the object are carried out in the second conveying path if required, then transferring the object to the subsequent process at a velocity which corresponds to a desired velocity of the object in the subsequent process.

11. Apparatus for positionally accurate feeding of sheet-like objects to a further treatment unit, wherein the sheet-like objects are conveyed in a lying position in succession, the apparatus comprising a conveyor apparatus on which the objects are to be aligned during their conveyance thereon, the conveyor apparatus having a direction of conveyance for conveying the objects in the direction;

the conveyor apparatus being mounted for rotation about a vertical axis relative to the conveying direction for connecting a skew position of the front edge of the object being conveyed;

the conveyor apparatus being displaceable transversely to the conveying direction generally along the plane in which the objects are conveyed for lateral alignment of the objects; and the conveyor apparatus being adapted to be accelerated or decelerated for displacing the objects in the conveying direction and to set a selected velocity for the objects;

the conveyor apparatus further comprising a sensor for sensing an edge of the object being conveyed on the conveyor apparatus.

12. The apparatus of claim 11, wherein the apparatus being mounted for rotating comprises the conveying apparatus being supported on a shaft extending across the plane of the objects being conveyed on the conveying apparatus and the conveying apparatus being rotatable about the shaft for correcting the skew position of the front edge of the object.

13. The apparatus of claim 11, wherein the conveyor apparatus being mounted for rotating comprises first and second conveyor means spaced from each other across the conveyor apparatus and each adapted to provide selected different conveying velocities and both being positioned so that each article being conveyed passes over the conveyor means for having any skew position thereof corrected by selected conveyor means velocities.

14. The apparatus of claim 11, wherein the conveyor apparatus comprises a first conveyor device in the path of the objects being conveyed followed by a second conveyor device in the path of the objects being conveyed; the conveyor apparatus being mounted for rotating comprises a shaft extending transversely to the conveyor apparatus and through the plane in which the objects are conveyed over the first conveyor device and the first conveyor device being rotatable about the shaft for correcting the skew position of the front edge of the object;

the second conveyor device being displaceable transversely to the conveying direction for displacing the objects being conveyed transversely.

15. The apparatus of claim 14, wherein the conveyor apparatus is accelerated or decelerated at the second conveyor device.

16. The apparatus of claim 11, further comprising a preliminary alignment and conveyor unit upstream of the conveyor apparatus in the conveying direction.

17. The apparatus of claim 11, wherein the sensor includes at least two spaced apart sensors at the conveyor apparatus positioned for detecting the front edge of the object being conveyed.

18. The apparatus of claim 11, wherein the sensor is positioned for detecting at least one of the front or rear edges of the object being conveyed on the conveying apparatus.

19. The apparatus of claim 18, further comprising a second sensor for detecting a side edge of the object being conveyed on the conveying apparatus.

20. The apparatus of claim 18, wherein the sensor comprises a CCD chip with a sensor matrix comprised of a plurality of light sensor elements and being so positioned that the coverage over the light sensor elements of the CCD chip is an indication of the position of the object on the conveyor apparatus.

21. The apparatus of claim 11, wherein the sensor is positioned for detecting a side edge of the object being conveyed on the conveying apparatus.

22. The apparatus of claim 21, wherein the sensor comprises a CCD chip with a sensor matrix comprised of a plurality of light sensor elements and being so positioned that the coverage over the light sensor elements of the CCD chip is an indication of the position of the object on the conveyor apparatus.

23. The apparatus of claim 11, wherein the sensor is normally located approximately at a corner area of the object being conveyed and the sensor being so shaped and positioned as to detect both a side edge and a front edge of the object being conveyed on the conveying apparatus.

24. The apparatus of claim 23, wherein the sensor comprises a CCD chip with a sensor matrix comprised of a plurality of light sensor elements and being so positioned that the coverage over the light sensor elements of the CCD chip is an indication of the position of the object on the conveyor apparatus.

25. The apparatus of claim 11, wherein the sensor comprises a CCD chip with a sensor matrix comprised of a plurality of light sensor elements and being so positioned that the coverage over the light sensor elements of the CCD chip is an indication of the position of the object on the conveyor apparatus.

26. The apparatus of claim 11, wherein the sensor comprises a laser scanner for locating the edge of the object.

* * * * *